United States Patent [19]

Newman, Sr. et al.

[11] Patent Number: 4,570,645

[45] Date of Patent: Feb. 18, 1986

[54] SAFETY HOLDER FOR CIGARETTES

[76] Inventors: William E. Newman, Sr., 207 Doncaster Rd., Joppa, Md. 21085; Paul D. Newman, 7 Nacelle Rd., Baltimore, Md. 21220

[21] Appl. No.: 557,442

[22] Filed: Dec. 2, 1983

[51] Int. Cl.[4] ..... A24F 13/16

[52] U.S. Cl. ..... 131/175; 131/349

[58] Field of Search ..... 131/175, 174, 349

[56] References Cited

U.S. PATENT DOCUMENTS 2,625,163 1/1953 Jones et al. ..... 131/175

*Primary Examiner*—V. Millin

*Attorney, Agent, or Firm*—John F. McClellan, Sr.

[57] ABSTRACT

A holder system for providing fire-safety of a cigarette being smoked and automatic extinguishment of it after a predetermined time includes a perforate tube with a spaced succession of internal rings that fit closely around a burning cigarette; in the absence of a puff on the cigarette within a predetermined time the burning end of the cigarette is extinguished as it reaches the nearest internal ring; the holder opens to receive a cigarette between identical halves separated along a longitudinal plane; an end cap and stud-in-hole structures provide for detachably securing the halves together.

1 Claim, 7 Drawing Figures

SAFETY HOLDER FOR CIGARETTES

Cross-reference is made to our co-pending application for U.S. pat., Ser. No. 545,697, filed Oct. 26, 1983 for FIRE-SAFE CIGARETTE HOLDER SYSTEM.

FIELD OF THE INVENTION

This invention relates generally to tobacco smoking accessories and particularly to cigarette holders.

SUMMARY OF THE INVENTION

A principal object of this invention is to produce a cigarette holder that is safe and renders cigarettes safer to smoke.

One of the common causes of death by fire is smoking cigarettes in bed; ignition of the bedding can cause fumes that asphyxiate victims, even before flames appear. An object of this invention is to prevent this.

Aircraft fires attributable to ignition of plastic furnishings by dropped cigarette carelessly set aside have caused deaths. An object of this invention is to reduce, if not eliminate, such accidents.

Further objects of this invention are to provide a cigarette holder making cigarettes not only safer to smoke in bed at home, and in aircraft, but also in hospitals, nursing homes, motels, boats and ships, and without taking away the enjoyment of smoking.

Yet further objects of the invention are to provide a cigarette holder that guards against impact, so that a cigarette dropped will not ignite anything, protecting rugs, chairs, tables, floors and the like, and not dropping ashes.

Still a further object is to provide a cigarette holder which can put a cigarette out in two minutes if the cigarette is not puffed in that time.

And further objects are to provide a cigarette holder as described that will fit any conventional cigarette, filter tip type or not; that will not stain fingers, and that is economical, durable and snaps apart for instant, easy cleaning.

And yet further objects are to provide a holder as described which will hold a cigarette firmly under all circumstances, that will extinguish it before it gets too short to hold firmly, that will not itself burn, that is simple, easy and foolproof to use, that is easily and economically made, and is attractive in appearance.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
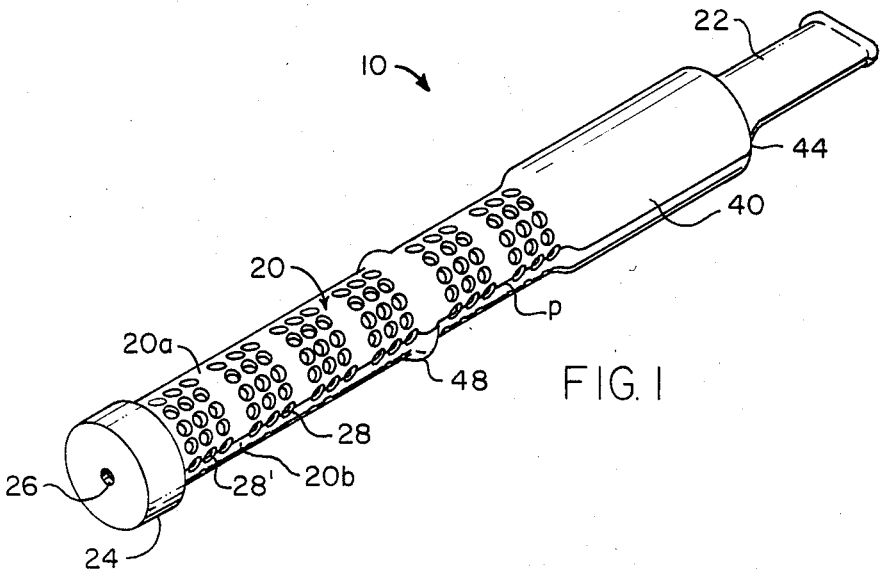
FIG. 1 is a perspective view of the invention.
Figure 2:
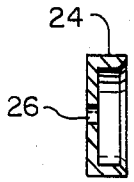
FIG. 2 is a sectional view of an end cap thereof.
Figure 3:
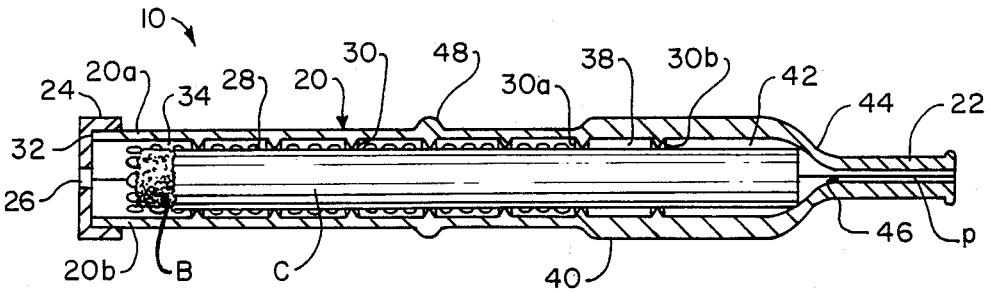
FIG. 3 is a longitudinal sectional view of the invention holding a cigarette.

FIGS. 1,2 and 3 show details of the invention in preferred embodiment 10, a tubular safety holder or system for firesafe guarding of a burning end of a cigarette, comprising a generally cylindrical perforate-wall body 20 with a stem 22 at one end. The body includes first and second snap-together longitudinal halves 20*a*, 20*b*, or enclosing means, separatable in a longitudinal plane p, generally through the diameter. This permits easy access to the interior of the two pieces for receiving a cigarette or for discharging a cigarette, and for cleaning. End cap 24 helps retain the two halves together as a backup safety and prevents ashes from dropping out. It has a small axial hole 26 in it for supplying more air initially to a cigarette.

A user puffs on generally flattened stem 22 or mouthpiece and draws air and smoke through a contained burning cigarette C, FIG. 3, into the mouthpiece.

As shown, a cigarette, when inside the safety holder, to an extent blocks entrance of air through the plurality of apertures 28 divided into triple circumferential rows by a plurality of inwardly protruding, cigarette-fitting rings 30 or internal barriers. The blockage is of chambers supplied with air by the apertures and is over a distance equalling the length of the cigarette. From the burning end B to the first or cap-end 32 air can enter freely through the apertures 28' into any of the serial chambers 34 formed by the rings and not blocked by the cigarette, including entering freely through the end aperture 26.

Means for extinguishing the cigarette in the absence of drawing air through it is provided as follows.

The unblocked apertures are sufficiently large to permit the cigarette to burn freely, but the cigarette cannot burn longer than two minutes (in the preferred embodiment) without a puff. The fit of an internal ring 30 will locally cool the cigarette and, to an extent, deprive it of oxygen, so that the cigarette will go out by itself when the burning portion reaches an internal ring and not pollute the atmosphere, instead of burning until consumed in the usual manner of an abandoned cigarette.

The internal rings or ring-shaped barriers 30 may be made closer together or farther apart than indicated, to control the free-burning time intervals. Sharp cutoff in time and easy passage to the next ventilated chamber 34 on puffing are provided preferably, in the form of a sharp-edged inner diameter 36 on the rings.

The cigarette ash supported in the enclosure tends to block axial supply of air to the cigarette. When the cigarette "burn" reaches the blind chamber 38 formed by the last two internal rings, 30*a*, 30*b*, those closest to the stem or mouthpiece and the imperforate wall 40 around it, the cigarette will not of itself burn longer, and is extinguished. This is a means for reducing possibility of smoking a cigarette too short, or of igniting the filter of a filter cigarette.

Axially behind or towards the mouthpiece end is a chamber 42 preferably longer than the equal spacing of the ventilated chambers, and that has the same inside diameter as the other chambers but that is reduced in a tapered portion, by the tapered walls 44, to a flattened passage 46 through the stem. The taper prevents rearward axial movement of a cigarette C.

The thickened wall portion or small peripheral ring 48 midway the length of the body is a reinforcement integral with snap-together fastening provisions in it, spaces the body perforations from a surface on which the safety holder is laid, and can be used as a cooler place to grip.

Similarly, the thickened, imperforate wall portion or large peripheral ring 40 adjacently forward of the stem 22 is a reinforcement integral with snap-together fastening provisions in it, spaces the perforations from a surface on which the safety holder is laid, and can be used as a cooler place to grip.

Spacing of the perforations from a surface on which the safety holder is laid not only is an additional safety feature but also assures a more even burn of the cigarette and increases uniformity of time of extinguishment if not puffed.

Figure 4:
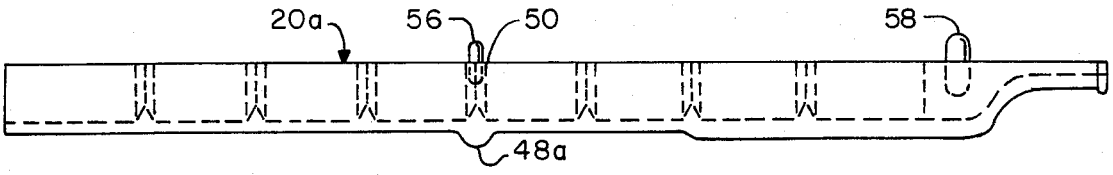
FIG. 4 is a longitudinal edge view of one of the snap-together halves making up the holder.
Figure 5:
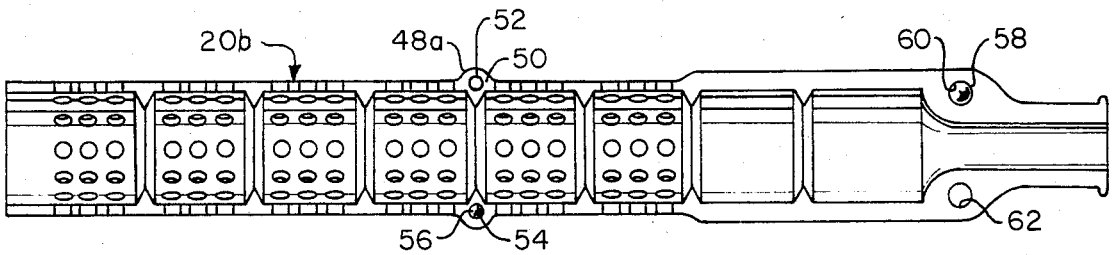
FIG. 5 is a longitudinal inner-face view of one of the snap-together halves.
Figure 6:
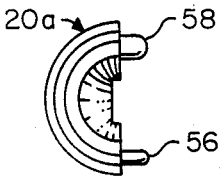
FIG. 6 is an end view of one of the snap-together halves.

FIGS. 4, 5 and 6 detail the snap-together fastening provisions of the two preferably identical halves 20*a*, 20*b*, FIGS. 4 and 5 respectively, of the safety holder. The halves are separated by a longitudinal plane. Each half has in each longitudinal plane edge 50 of the small peripheral ring half 48*a*, a small hole 52, 54. In one of these holes a capsule-shaped stud is force fitted, cemented, or otherwise secured with a portion 56 projecting for engagement with the hole other identical half.

Similarly, a second stud 58 is provided, projecting from one of a pair of preferably larger holes 60, 62 in the second, longer or larger peripheral ring wall 40. The studs are diagonally located so that each half can be exactly the same.

If desired, the studs may be integrally molded portions, and the smaller ring may be substituted by local ears or bosses at the diametral end locations.

Figure 7:
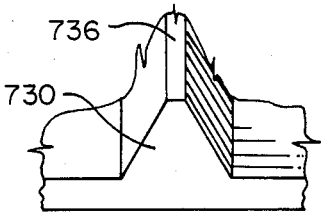
FIG. 7 is a detail of an alternative embodiment, viewed the same way as FIG. 5.

FIG. 7 shows in fragmentary detail an alternative shape for an internal ring 730, similar to the first embodiment except that the inside diameter 736 of the ring is cylindrical instead of sharp. This feature makes extinguishment even more certain in the absence of a puff, and requires a longer or harder puff to keep a cigarette lit. This feature also assures that even wet paper on a cigarette will not be cut on snapping together the halves of the safety holder. The axial length of the cylindrical portion may be 0.5 m.

The safety holder may have any number of ventilated chambers desired, six being preferred in the dimensions of the preferred embodiment, which are substantially as follows, for use with any standard size cigarette:

overall length about five inches (12.5 cm)
axial distance between internal rings ⅜ inch (9 mm)
I.D. of internal rings 0.3 inch (7.5 mm)
diameter of aperture 1/16 inch (1.5 mm)
center spacing of apertures:
  axially, 0.115 inch (3 mm)
  circumferentially, 15 degrees on center
diameter of hole in end cap 1 1/6 inch (1.5 mm)
body wall thickness 1/32 inch (0.8 mm)

In operation, the user merely removes the cap, snaps apart the halves (which have the studs fitting the hole sufficiently tightly to prevent accidental falling open) places a lighted cigarette inside preferably with the burning end just rearward of the first internal ring, closes the halves, puts on the end cap and is ready to smoke.

After the cigarette is smoked, it may be withdrawn and discarded.

During smoking of the cigarette, if no puff is taken within about a two minute interval in which the perforations promote burning, as when the invention is laid or dropped on a table, bed, ashtray or other rest, the cigarette burns to the next internal ring, and is extinguished by oxygen starvation, without injury to the surroundings in the interim.

This surprisingly effective function results from the dimensions of the configuration and the material, which does not transfer heat rapidly.

It should be noted that the greater diameter of the end cap also provides a fire-safety recess around the middle portion when the invention is laid down. Standing the invention on end will simply extinguish a cigarette faster.

Material for the fire safe cigarette holder of this invention may be "Teflon" plastic for all three parts, "Teflon" plastic being non-combustible, and heat resistant within the range of temperatures produced by smoking cigarettes. "Teflon" is a registered trademark for a polytetrafluoroethylene.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. A system for fire safe guarding of a burning end of a cigarette, comprising: means for enclosing a cigarette with a burning end, means for drawing air for combustion through a said cigarette, from the burning end along the length of the cigarette, means for extinguishing the burning end of a said cigarette at any of a plurality of predetermined times in the absence of said drawing of air through the cigarette; the system having first and second ends, the means for drawing air including a plurality of circumferential rows of apertures through the means for enclosing adjacent said first end, a mouthpiece at said second end, said means for extinguishing including an axially spaced series of internal rings, in said means for enclosing and dividing the circumferential rows of apertures into groups, each internal ring proportioned for fitting around a portion of a cigarette and cooling it and depriving it of air to the point of extinguishment in said absence of drawing of air; said means for enclosing including a tubular body, said tubular body comprising substantially identical halves taken along a longitudinal plane, and separable for loading a cigarette therein, means holding said halves together including a cap on said first end, and means for reducing possibility of smoking a cigarette too short, comprising a portion of said tubular body adjacent the mouthpiece being without said apertures.

* * * * *